US005385661A

United States Patent [19]

Andricacos et al.

[11] Patent Number: 5,385,661

[45] Date of Patent: Jan. 31, 1995

[54] ACID ELECTROLYTE SOLUTION AND PROCESS FOR THE ELECTRODEPOSITION OF COPPER-RICH ALLOYS EXPLOITING THE PHENOMENON OF UNDERPOTENTIAL DEPOSITION

[75] Inventors: Panayotis C. Andricacos, Croton-on-Hudson; I-Chia Chang, Peekskill, both of N.Y.; Hariklia Deligianni, Edgewater, N.J.; Wilma J. Horkans, Ossining, N.Y.

[73] Assignee: International Business Machines Corporation, Armonk, N.Y.

[21] Appl. No.: 123,623

[22] Filed: Sep. 17, 1993

[51] Int. Cl.[6] ..... C25D 3/58

[52] U.S. Cl. ..... 205/239; 205/241

[58] Field of Search ..... 205/23.9, 241, 242

[56] References Cited

U.S. PATENT DOCUMENTS

| | | | |
|---|---|---|---|
| 2,910,413 | 10/1959 | Strauss et al. | 204/44 |
| 2,973,308 | 2/1961 | Schimkus | 205/239 |
| 3,023,150 | 2/1962 | Willmund et al. | 204/44 |
| 3,812,020 | 5/1974 | Mey | 205/239 |
| 4,038,161 | 7/1977 | Eckles et al. | 204/52 |
| 4,347,107 | 8/1982 | Teichmann et al. | 204/44 |
| 4,381,228 | 4/1983 | Teichmann et al. | 204/44 |
| 4,389,286 | 6/1983 | McCoy | 204/44 |
| 5,039,576 | 8/1991 | Wilson | 204/44.4 |

FOREIGN PATENT DOCUMENTS

| | | | |
|---|---|---|---|
| 0160065 | 1/1964 | U.S.S.R. | 205/241 |
| 0211992 | 2/1968 | U.S.S.R. | 205/241 |

OTHER PUBLICATIONS

L. Lagiewka & L. Pajak, "The Structure of Cu-Cd Alloys Obtained Electrolytically Under Galvanostatic Conditions," *Thin Solid Films, 198,* pp. 211-220 (1991).

D. Kolb, "Physical and Electrochemical Properties of Metal Monolayers on Metallic Substrates," in *Advances in Electrochemistry and Electrochemical Engineering,* vol. 11, p. 125, H. Gerischer and C. Tobias, eds. (Wiley Interscience, N.Y., 1978).

A. Brenner, *Electrodeposition of Copper-Tin Alloys,* ch. 15 (Academic Press, N.Y., 1963).

T. Pearson & J. Dennis, "The Effect of Pulsed Reverse Current on Polarization Behavior of Acid Copper Plating Solutions Containing Organic Additives," J. Appl. Electrochem., 20, 196-208 (1990).

*CRC Handbook of Physics and Chemistry,* 67th ed., pp. D151-154 (CRC Press, Boca Raton 1986).

*Primary Examiner*—John Niebling
*Assistant Examiner*—Kishor Mayekar
*Attorney, Agent, or Firm*—Ratner & Prestia

[57] ABSTRACT

An acidic electrolytic solution for use in the electrodeposition of copper-rich alloys on a substrate, the less noble component being incorporated by underpotential deposition. The solution includes a first salt containing copper cations; a second salt containing cations of a metal less noble than copper; and an acid electrolyte (e.g., methane sulfonic acid) such that at typical current densities the potential is in the range of underpotential deposition of the less noble metal on the copper.

Also provided is a process for using the acidic electrolytic solution. The process includes the following steps: (1) selecting a copper-rich alloy having, as the minor component, a metal that is less noble than copper and can form an underpotential deposition layer on copper; (2) selecting an acid electrolyte such that at typical current densities the potential is in the range of underpotential deposition of the metal on the copper; (3) providing in the acid solution simple salts of copper and of the less noble metal; and 4) applying a current between a cathode and an anode placed in the plating solution to plate the alloy on the cathode.

20 Claims, 1 Drawing Sheet

ACID ELECTROLYTE SOLUTION AND PROCESS FOR THE ELECTRODEPOSITION OF COPPER-RICH ALLOYS EXPLOITING THE PHENOMENON OF UNDERPOTENTIAL DEPOSITION

BACKGROUND OF INVENTION

A. Field of Invention

The present invention relates generally to the electroplating of alloys of two metals having reversible potentials sufficiently separated that they cannot be readily co-deposited from their simple cations. Specifically, a copper-rich alloy is electrodeposited from a plating solution in which, at typical current plating densities, the potential is positive to the reversible plating potential of the minor component to be alloyed with the copper. This minor component is a metal less noble than copper and is incorporated in the alloy by the mechanism of underpotential deposition (UPD) on the co-deposited copper. More particularly, the present invention is related to a methane sulfonic acid solution, which contains the cations of copper and another, less noble metal, useful in the deposition of copper-rich alloys by facilitating the UPD of the less noble metal on copper. The occurrence of UPD during electroplating results in the deposition of an alloy of copper with the less noble metal.

B. Description of Related Art

Electrodeposition of copper deposits containing small amounts of alloying metals is useful in a number of applications in which it is desirable to modify the physical or chemical properties such as hardness and corrosion resistance of the copper. Copper alloys are also being investigated, for their resistance to electromigration, as materials for chip wiring. For this application, it is important that the alloying material be at a very low level and have a very small effect on the copper resistivity. Electromigration-resistant copper alloys meeting these criteria are, however, difficult to deposit by the usual methods.

Certain alloys, including commercially important copper-based alloys, are difficult to electrodeposit because the components of the alloy have widely different reversible deposition potentials. The standard electrode potentials of copper (0.34 volts) and tin (−0.14 volts) in divalent salt solutions of the simple ions, for example, are about 0.5 volts apart. *CRC Handbook of Physics and Chemistry,* 67th ed., pp. D-151-154 (CRC Press, Boca Raton 1986). Thus, co-deposition of the two metals in a coherent form from mixtures of their simple salts is difficult, especially when copper is the major component of the alloy.

Conventional processes typically overcome such difficulties either by complexing the ion of the more noble metal, copper, in solution, to bring its reversible potential closer to that of the less noble metal ion (e.g., tin), or by depositing the more noble metal at its limiting current.

Neither of these expedients is entirely satisfactory. First, one of the most effective complexants, cyanide, poses environmental hazards. Second, complexation generally requires higher pH values because, at lower pH, common complexing agents are usually protonated and, consequently, do not function effectively. Use of complexants and higher pH complicates the solution chemistry and may reduce the current efficiency of electrodeposition and change the properties of the electrodeposit. High pH solutions may also be incompatible with polymers used in microelectronic fabrication. Third, deposition of the major component of the alloy at its limiting current is highly undesirable, because such deposits generally have poor metallurgical properties. In general, deposition at the diffusion limited current can be successfully used only for the minor component of an alloy. Thus, the minor component must be the more noble metal for this mechanism of codeposition to be feasible.

Conventional methods for electrodepositing copper and copper-based alloys have been used for many years. Bronze, which is a copper-tin alloy, was plated over 100 years ago using a bath containing copper as a cyanide complex and potassium stannate. A. Brenner, Electrodeposition of Alloys, ch. 15 (Academic Press, New York, 1963). Improvements were made to these plating processes by establishing the optimum operating conditions of the processes and by incorporating additives into the plating baths. Brighteners for producing a brilliant copper finish, levelers to impart a smooth finish, wetting agents, and agents to promote anode corrosion are among the prior art additives that have been developed and described.

Some of the patents that generally disclose these prior art electroplating processes and the additives used include:

U.S. Pat. No. 2,910,413 is one of the many patents related to addition agents for copper plating. The '413 patent discloses a brightening additive that may be used in conjunction with other organic addition agents and that is intended to be useful in electroplating copper, bronze, and brass. The brightener works best in conjunction with a sulfonic acid containing a halogen or pseudo-halogen which is at low concentration and is not a major solution component.

U.S. Pat. No. 3,023,150 is another of the numerous patents in the field of brightening agents for acid copper plating. The '150 patent generally discloses additives that are intended to be useful in all types of plating systems including electrodepositing of copper, brass, and bronze. Among the brighteners specified are derivatives of mercaptopropane sulfonic acid which serve as addition agents at low concentrations.

U.S. Pat. No. 4,038,161 does not teach alloy plating but discloses chemical addition agents to provide levelling behavior in acid copper plating.

U.S. Pat. No. 4,347,107 pertains primarily to the deposition of tin. Although the '107 patent suggests that copper and rhodium be incorporated in the tin deposit, a tin-based alloy is electrodeposited. The copper must be at a very low concentration in the solution and is deposited at its diffusion limiting current because it is the more noble of the two metals in the alloy. Good quality copper-based alloys cannot be deposited near the diffusion limiting current and, therefore, the teaching of the '107 patent could not be used to deposit copper-rich alloys.

U.S. Pat. No. 4,381,228 also teaches a method of depositing tin and tin-rich alloys of copper and rhodium using a mixed fluoroboric/sulfuric acid system to avoid the problem of anode passivation. Appropriate addition agents are also used.

U.S. Pat. No. 4,389,286 teaches deposition of high-copper alloys of copper-tin and copper-lead using a glucoheptonic acid salt as a complexing agent instead of cyanide. Although the solution does not contain cyanide, it is still highly alkaline, with a pH above 12, rendering the solution incompatible with most microelectronic processes because polymers are generally attacked at very high pH.

U.S. Pat. No. 5,039,576 teaches an electroplating bath, cell, and method for the electrodeposition of tin-bismuth alloys onto a conductive substrate using an alkyl sulfonic or polysulfonic acid or salt as the electrolyte. Although copper plating using methane sulfonic acid is disclosed, neither copper alloys nor UPD is mentioned.

The prior art plating processes have many drawbacks. First, the solutions used to electroplate both copper and copper-based alloys generally include additives. Solutions used to electroplate copper-rich alloys typically use toxic chemicals, such as cyanide, which present safety, handling, and disposal problems. In the absence of a complexant like cyanide, the less noble metal will not begin to deposit unless the plating current density is higher than the diffusion limited current density for copper. For copper-rich alloys, the result of plating the alloy above the copper limiting current will be a deposit with poor physical and metallurgical properties. Finally, the prior art processes are often incompatible with materials such as polymers used in microelectronic processing.

The phenomenon of deposition from solution of atomic layers of a metal on a foreign metal substrate at potentials positive to its reversible Nernst potential is known as underpotential deposition (UPD). The name derives from the fact that the metal monolayer is formed before bulk deposition can occur. Typically, a less noble metal may form a UPD layer on a more noble metal.

The thermodynamic equilibrium potential for UPD is determined by: 1) the activities of the ions in solution, 2) the activity of the solid phase (which is not unity in the case of monolayers), and 3) the specific interactions between the deposit and the substrate. Thus, the UPD phenomenon depends on the substrate-deposit pair chosen. The degree of interaction is related to the difference between the work functions of the two metals. Examples of widely studied UPD systems are Pb, Sn, Cd, Ag, Cu (and others) on Au; Pb, Sn, Tl, As, Cu (and others) on Ag; and Pb, Zn, Cd (and others) on Cu. An extensive list would include many other metal pairs.

An advantage of exploiting UPD in the deposition of alloys is that the very metal pairs that give strong UPD interactions, a less noble metal on a more noble metal substrate, are the most difficult pairs to co-deposit using conventional electrodeposition technology. Thus, UPD makes it possible to electrodeposit alloys that are difficult to deposit by other means.

Although UPD layers, which are on the order of a monolayer in thickness, usually form and desorb nearly reversibly, the formation of surface alloys between a UPD metal layer and the substrate metal has been observed in the prior art. D. Kolb, "Physical and Electrochemical Properties of Metal Monolayers on Metallic Substrates," in *Advances in Electrochemistry and Electrochemical Engineering,* Vol. 11, p. 125, H. Gerischer and C. Tobias, eds. (Wiley Interscience, New York, 1978). Such surface alloy formation was studied under near-equilibrium conditions. The substrate was a well-defined surface of the more noble metal, and the solution contained only cations of the less noble metal in an inert electrolyte. The role of UPD in the non-equilibrium phenomenon of continuous co-deposition of the two metals has not been studied.

For alloy deposition to occur by UPD during deposition of a more noble metal from a solution also containing ions of a second, less noble metal, three conditions must be met: 1) the deposition reaction must take place in the potential region of UPD, 2) the UPD layer of the less noble metal must be incorporated in the alloy rather than desorbing, and 3) the solution must not contain any species which are strongly absorbed on the surface and inhibit the formation of UPD layers.

The present invention incorporates UPD to overcome the shortcomings of existing processes used to electrodeposit copper-based alloys. Specifically, a new electroplating solution and a process of using that solution are provided. An object of this invention is to exploit UPD to deposit copper-rich alloys having components with very different reversible electrochemical potentials, with Cu—Sn and Cu—Pb being exemplary alloys to be plated.

Another object is to provide a non-complexing acid electrolyte solution and method of using that solution for plating copper-rich alloys in which the deposition of neither component is diffusion controlled (i.e., deposited at its limiting current). Yet another object is to provide a solution for plating such alloys which does not require additives, does not contain complexants for ions of either of the metal alloying components, and does not include toxic chemicals such as cyanides.

It is still another object of the present invention to provide a solution and method of using that solution for plating copper-rich alloys that are compatible with materials, such as polymers, used in microelectronic processes. It is a further object to assure good quality metallurgical properties of such alloys.

SUMMARY OF THE INVENTION

To achieve these and other objects, and in view of its purposes, the present invention provides an acidic electrolytic solution for use in the electrodeposition of copper-rich alloys on a substrate, the less noble component being incorporated by underpotential deposition. The solution includes a first salt containing copper cations; a second salt containing cations of a metal less noble than copper; and an acid electrolyte (e.g., methane sulfonic acid) such that at typical current densities (e.g., about 5 to about 50 mA/cm2) the potential is in the range of underpotential deposition of the less noble metal on the copper.

Also provided is a process for using the acidic electrolytic solution. The process includes the following steps: (1) selecting a copper-rich alloy having, as the minor component, a metal that is less noble than copper and can forman underpotential deposition layer on copper; (2) selecting an acid electrolyte such that at typical current densities the potential is in the range of underpotential deposition of the metal on the copper; (3) providing in the acid solution simple salts of copper and of the less noble metal; and 4) applying a current between a cathode and an anode placed in the plating solution to plate the alloy on the cathode.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawing, in which.

DETAILED DESCRIPTION OF THE INVENTION

Figure 1:
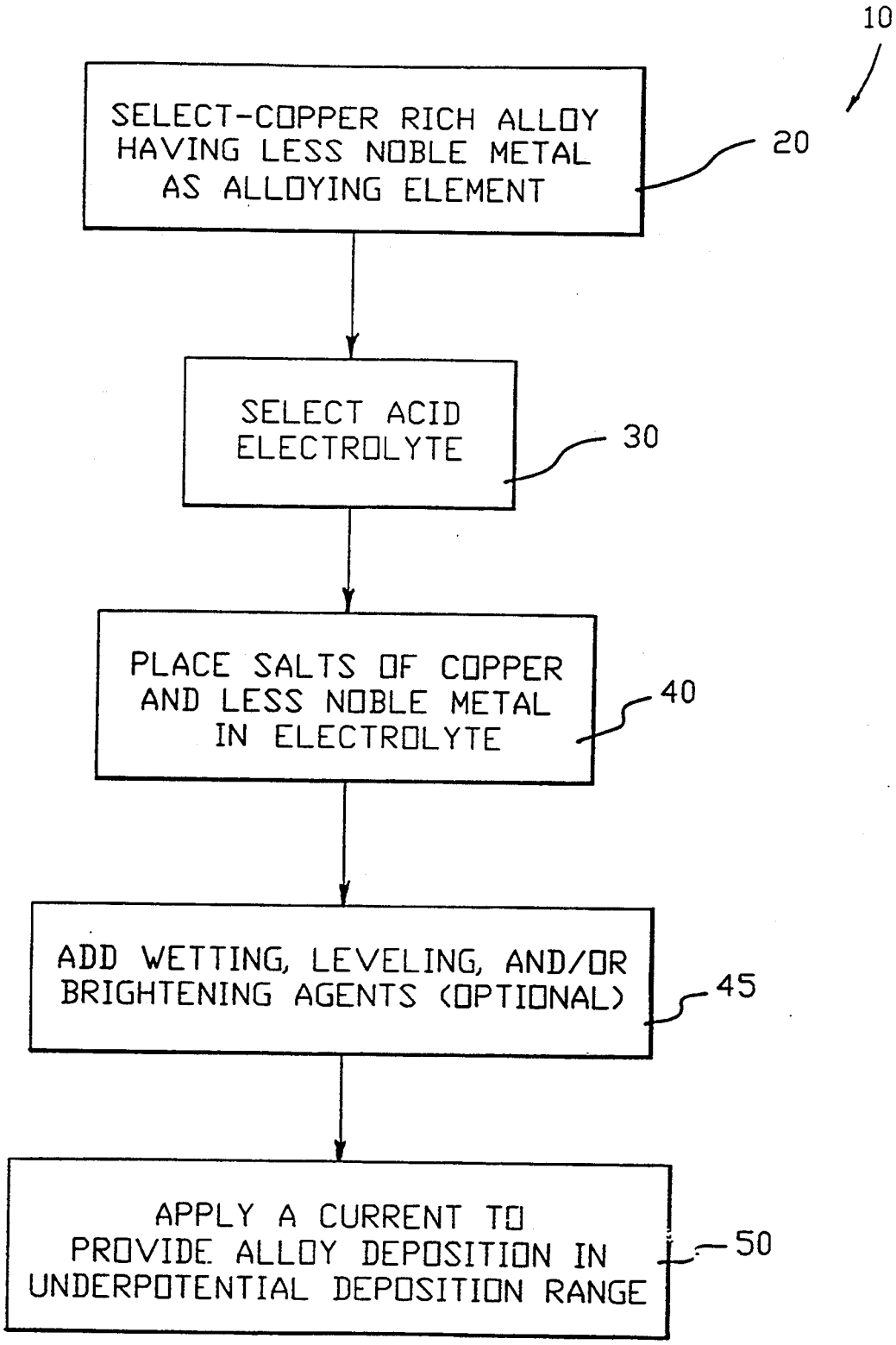
FIG. 1 is a flow chart illustrating the process of the present invention.

A non-complexing acid electrolytic solution (acid concentration less than about 0.1N and preferably less than about 1N) and a process of using that solution for electroplating copper-rich alloys having a minor alloying component that is less noble than copper are disclosed. The mechanism by which the second, less noble metal is incorporated in the deposit is through UPD of that metal on copper. An important parameter in rendering the UPD mechanism workable is the electrolytic solution constituting the conductive medium in which the metal salts are dissolved; the solution must be chosen so that, at typical plating current densities, the potential range of alloy deposition coincides with the potential range of UPD of the minor alloying component on the copper. Deposition from the conventional sulfuric acid copper plating solutions occurs at a potential too positive for the UPD of the alloying elements of interest to occur on copper.

Although copper-tin and copper-lead alloys are specifically described, these alloys are provided only for purposes of example and illustration. Thus, other metals, less noble than copper, that form underpotential deposits on copper can be co-deposited with copper using the solution and process of the present invention. These metals include, but are not limited to, thallium, cadmium, bismuth, arsenic, and antimony. The invention is directed toward electrodepositing alloys of two metals having reversible potentials sufficiently separated that they cannot be readily co-deposited from solutions of their simple ions. Such alloys include pairs of metals that have reversible potentials separated by as little as about 100 millivolts to as much as several hundreds of millivolts.

Successful electroplating of the copper-rich alloys of interest has been accomplished by plating in a solution of methane sulfonic acid (MSA). The MSA is used in concentrations in the range from 0.1–3N, with 1–2N being preferred, to provide the conducting ionic medium in which the metal salts are dissolved.

Like sulfuric acid, MSA is a strong acid in which Cu(II) is soluble. Unlike sulfuric acid, however, MSA allows copper plating to occur simultaneously with UPD. The copper deposition kinetics, which affect the potential range for copper plating, are slower in MSA than in sulfuric acid. The faster deposition kinetics of copper in sulfuric acid result in a potential range for copper plating that is too positive for UPD of Sn to occur simultaneously. (Note that Pb(II) is insoluble in sulfate solutions). The slower deposition kinetics of copper in MSA, however, result in a more negative potential plating range and, coincidentally, one which is within the range of UPD for the Sn/Cu system.

Both Sn (II) and Pb (II) are soluble in MSA and this chemistry can be used to deposit Cu—Sn and Cu—Pb alloys. Sn(II) can be added to the solution in the form of its sulfate or methane sulfonate salts, $SnSO_4$ or $Sn(O_3SCH_3)_2$. Pb(II) can be added in the form of its acetate or methane sulfonate salts, $Pb(OOCCH_3)_2$ or $Pb(O_3SCH_3)_2$.

A basic copper solution was tested which consisted of 0.27M $Cu(OOCCH_3)_2$ (copper acetate) in 2 N MSA. Copper plating was examined on a rotating disk electrode at a rotation rate of 350 rpm. At a current density of 20 mA/cm$^2$, copper is deposited from this solution at about −0.83 volts versus $Hg/Hg_2SO_4$, which has a potential of +0.64 volts versus NHE (Normal Hydrogen Electrode). This is a very negative potential compared to the usual potential (e.g., about −0.5 to −0.6 volts verses $Hg/Hg_2SO_4$) for copper deposition from acid solution. A separate investigation found that the UPD of tin and lead on copper occurs in the region negative to about −0.65 volts and, therefore, the deposition of pure copper from MSA occurs in the region of UPD of these metals.

Metallic additions to the $Cu(OOCCH_3)_2$/MSA plating solution depolarize the deposition reaction (i.e., at constant plating current density, the plating potential is shifted in the positive direction). The addition of 20 mM Sn(II) or Pb(II) caused deposition at 20 mA/cm$^2$ to occur at −0.56 volts and −0.76 volts, respectively. Deposits from these two solutions had an excellent appearance. Lead is incorporated in the deposit from the Pb(II)-containing solution because the potential of −0.76 volts is sufficiently negative to be in the UPD region. The depolarization by Sn(II) is greater than that by Pb(II); the potential of −0.56 volts attained in solutions with Sn(II) is positive to the UPD region, and only pure copper is deposited from this solution.

In order to electrodeposit Cu—Sn alloys using the UPD mechanism, addition agents must be used to manipulate the potential of deposition from Sn(II)-containing solutions into the UPD region. The Sn(II) itself is sufficiently depolarizing that pure copper is plated from an additive-free solution containing Sn(II). As long as the addition agents do not themselves interfere with the UPD, they can be used for the electrodeposition of either Cu—Sn or Cu—Pb.

Typical addition agents for copper plating have been examined by, for example, T. Pearson & J. Dennis, "The Effect of Pulsed Reverse Current on the Polarization Behavior of Acid Copper Plating Solutions Containing Organic Additives," J. Appl. Electrochem., 20, 196–208 (1990). The wetting agent polyethylene glycol (PEG) and the common brightener mercaptopropane sulfonic acid (MPS) have been examined in the deposition of Cu—Sn and Cu—Pb from MSA solution. Both of these additives polarize the deposition reaction relative to deposition from $Ca(OOCCH_3)_2$/MSA/M(II) (where M is Sn or Pb). These agents shift the deposition potential in the presence of Sn(II) into the UPD range and allow the electroplating of Cu—Sn alloys with low tin levels (compositions that are difficult to achieve by other means) having good physical and electrical properties. Thus, PEG and MPS additives can serve the purpose of polarizing copper deposition into the required potential range.

It is believed that the role of PEG and MPS is that they affect the alloy formation by an indirect route and not by direct participation in the UPD process. For one metal to form a UPD layer on a foreign metal substrate, the interaction between the UPD metal and the substrate metal must be strong. A species, whether organic or inorganic, that also interacts strongly with the substrate will interfere with the UPD. It appears, therefore, that PEG and MPS must not play a direct role in the UPD of either Sn or Pb on Cu. It is known, however, that these addition agents influence the electrode kinetics of the copper deposition reaction. This is the mechanism by which they influence the structure of the copper deposit. A slowing of the copper deposition kinetics will shift the potential of copper plating to a more negative potential. When this occurs in the presence of the addition agents, the potential is coincidentally shifted into the potential range of UPD.

The table below summarizes a few of the compositions achieved. Note that neither of the components in either of the alloys is deposited at its diffusion limiting current. Because the Sn(II) depolarizes the copper deposition reaction, the Sn(II) concentration affects the tin content of the alloy in an unusual manner: the tin content of the alloy decreases as the Sn(II) solution concentration increases.

Compositions of Electroplated Cu—Sn and Cu—Pb

| Solution Additions | i ($mA/cm^2$) | E (V vs. MSE) | Pb at % | Sn at % |
|---|---|---|---|---|
| 20 mM Pb(II) | 20 | −0.76 | 0.5 | |
| 20 mM Pb(II) + MPS + PEG | 20 | −0.80 | 1.0 | |
| 20 mM Pb(II) | 40 | −0.78 | 0.8 | |
| 20 mM Pb(II) + MPS + PEG | 40 | −0.82 | 1.4 | |
| 20 mM Sn(II) | 20 | −0.56 | | n.d. |
| 20 mM Sn(II) | 40 | −0.62 | | n.d. |
| 10 mM Sn(II) + MPS + PEG | 20 | −0.78 | | 4.0 |
| 20 mM Sn(II) + MPS + PEG | 20 | −0.76 | | 3.3 |
| 50 mM Sn(II) + MPS + PEG | 20 | −0.60 | | <0.1 |
| 10 mM Sn(II) + MPS + PEG | 40 | −0.85 | | 6.5 |
| 20 mM Sn(II) + MPS + PEG | 40 | −0.82 | | 7.3 |
| 50 mM Sn(II) + MPS + PEG | 40 | −0.76 | | 3.4 |

Although the implementation of this invention is illustrated for the Cu—Sn and Cu—Pb alloys, the concept can be used to produce alloys of other pairs of metals for which the minor component forms a UPD layer on the major component. The requirements are those set out above, namely, the deposition must take place in the potential range of UPD and no species that inhibits UPD can be present.

Shown in the figure is a flow diagram 10 of the steps of the process in accordance with the invention of using the non-complexing acid electrolyte solution discussed above to deposit copper-rich alloys. The minor component is incorporated by a UPD mechanism. The first step 20 is to select a copper-rich alloy having, as the minor component, a metal that is less noble than copper and can forman underpotential deposition layer on copper. In the second step 30, an acid electrolyte is selected such that, at typical plating current densities, the potential is in the range of underpotential deposition of the metal on copper. Next, in third step 40, simple salts of copper and of the less noble metal are dissolved in the acid solution to provide the plating solution. Finally, in fourth step 50, a current is passed between a cathode and an anode placed in the plating solution, resulting in the electroplating of the alloy on the cathode.

Additional, optional steps may be included in process 10. Before applying a current in step 50, a step 45 may be included in which one or more of a wetting, leveling, or brightening agent, which maintains the deposition potential in the range of underpotential deposition and does not inhibit UPD, is added to the acidic electrolytic solution.

Although the invention is illustrated and described herein as embodied in an acidic electrolytic solution for use in the underpotential deposition of copper-rich alloys on a substrate, and a method of using that solution, it is nevertheless not intended to be limited to the details shown. Rather, various modifications may be made in the details within the scope and range of equivalents of the claims and without departing from the spirit of the invention.

What is claimed is:

1. An acidic electrolytic solution for use in the electroplating of copper-rich alloys on a substrate using a deposition potential, said solution comprising:

a first salt containing copper cations;

a second salt containing cations of a metal less noble than copper; and a methane sulfonic acid electrolyte adapted to permit underpotential deposition of said less noble metal on said copper and the electroplating of said copper-rich alloy on the substrate.

2. An electrolytic solution as recited in claim 1 wherein the concentration of the methane sulfonic acid is in the range from 0.1 to 3N.

3. An electrolytic solution as recited in claim 2 wherein the concentration of the methane sulfonic acid is in the range from 1 to 2N.

4. An electrolytic solution as recited in claim 1 wherein said first salt is copper acetate.

5. An electrolytic solution as recited in claim 4 wherein said second salt is stannous sulfate.

6. An electrolytic solution as recited in claim 4 wherein said second salt is selected from the group consisting of lead acetate and lead methane sulfonate salts.

7. An electrolytic solution as recited in claim 1 wherein said metal is selected from the group consisting of tin, lead, thallium, cadmium, bismuth, arsenic, and antimony.

8. An electrolytic solution as recited in claim 1 wherein said copper cations and said metal cations contained in said second salt are uncomplexed.

9. An electrolytic solution as recited in claim 1 further comprising a wetting agent that maintains the deposition potential in the range of underpotential deposition.

10. An electrolytic solution as recited in claim 9 wherein said wetting agent is polyethylene glycol.

11. An electrolytic solution as recited in claim 1 further comprising a brightening agent that maintains the deposition potential in the range of underpotential deposition.

12. An electrolytic solution as recited in claim 11 wherein said brightening agent is mercaptopropane sulfonic acid.

13. A method for electrodepositing copper-rich alloys on a substrate using a deposition potential, the method comprising the steps of:

selecting a copper-rich alloy having, as the minor component, a metal that is less noble than copper and form an underpotential deposition layer on copper;

selecting a methane sulfonic acid electrolyte adapted to permit the underpotential deposition of said less noble metal on said copper and the electrodepositing of said copper-rich alloy on the substrate;

dissolving in said acid electrolyte simple salts of said metal and said copper that will be deposited as said copper-rich alloy to form the plating solution;

applying a current between a cathode and an anode in said plating solution to electroplate said copper-rich alloy on the cathode.

14. The method as recited in claim 13 wherein the concentration of the methane sulfonic acid is in the range from 0.1 to 3N.

15. The method as recited in claim 14 wherein the concentration of the methane sulfonic acid is in the range from 1 to 2N.

16. The method as recited in claim 13 wherein said metal is selected from the group consisting of tin, lead, thallium, cadmium, bismuth, arsenic, and antimony.

17. The method as recited in claim 13 further comprising, before applying a current, adding to said plating solution a wetting agent that maintains the deposition potential in the range of underpotential deposition.

18. The method as recited in claim 17 wherein said wetting agent is polyethylene glycol.

19. The method as recited in claim 13 further comprising, before applying a potential, adding to said acidic electrolytic solution a brightening agent that maintains the deposition potential in the range of underpotential deposition.

20. The method as recited in claim 19 wherein said brightening agent is mercaptopropane sulfonic acid.

* * * * *